US011884435B2

(12) United States Patent
Rosignoli et al.

(10) Patent No.: US 11,884,435 B2
(45) Date of Patent: Jan. 30, 2024

(54) METHOD AND APPARATUS FOR AUTOMATICALLY BOXING PRODUCTS ON STICK

(71) Applicant: CT PACK S.R.L., Valsamoggia (IT)

(72) Inventors: David Rosignoli, Pontegradella (IT); Alberto Bonazza, Ferrara (IT); Elia Zaghi, Portomaggiore (IT)

(73) Assignee: CT PACK S.R.L., Valsamoggia (IT)

( * ) Notice: Subject to any disclaimer, the term of this patent is extended or adjusted under 35 U.S.C. 154(b) by 352 days.

(21) Appl. No.: 17/242,926

(22) Filed: Apr. 28, 2021

(65) Prior Publication Data

US 2021/0339901 A1 Nov. 4, 2021

(30) Foreign Application Priority Data

Apr. 29, 2020 (IT) ..... 102020000009424

(51) Int. Cl.

*B65B 57/06* (2006.01)
*B65B 25/00* (2006.01)
*B65B 35/36* (2006.01)

(52) U.S. Cl.

CPC ..... *B65B 57/06* (2013.01); *B65B 25/007* (2013.01); *B65B 35/36* (2013.01)

(58) Field of Classification Search

CPC ..... B65B 7/06; B65B 25/007; B65B 35/36
See application file for complete search history.

(56) References Cited

U.S. PATENT DOCUMENTS 2,850,148 A * 9/1958 Rasmusson ..... B65B 35/36 198/620
2,894,652 A * 7/1959 Glass ..... A23G 9/10 198/470.1
3,933,236 A * 1/1976 Aterianus ..... B65B 35/54 198/418.6
4,287,980 A * 9/1981 Montferme ..... B65G 47/71 198/470.1
4,318,563 A * 3/1982 Fowler ..... A23G 9/26 294/87.11
4,370,844 A * 2/1983 Degn ..... B65B 25/007 53/550
4,530,435 A * 7/1985 Stohlquist ..... B65B 25/006 198/374

(Continued)

OTHER PUBLICATIONS

Italian Search Report dated Jan. 21, 2021 from counterpart Italian Patent Application No. 202000009424.

*Primary Examiner* — Timothy L Maust
(74) *Attorney, Agent, or Firm* — SHUTTLEWORTH & INGERSOLL, PLC; Timothy J. Klíma

(57) ABSTRACT

Described is an apparatus for automatically boxing products on stick including: a closed transport line, a plurality of units, each movable independently, along the transport line in a feed direction, each including a retaining system for retaining a product on stick, an unloading unit configured for picking up a predetermined number of products on stick from the units and boxing said predetermined number of products on stick, a control and return unit, positioned upstream relative to the unloading unit relative to the feed direction along the transport line, configured for controlling the presence of products on stick in the units moving along the forward guide, for selectively interrupting the movement of the units in the feed direction.

15 Claims, 8 Drawing Sheets

(56) References Cited

U.S. PATENT DOCUMENTS

| | | | | |
|---|---|---|---|---|
| 11,543,794 | B2 * | 1/2023 | Bonazza | B65B 35/36 |
| 2014/0157732 | A1 * | 6/2014 | Gasber | B65B 25/008 53/235 |
| 2015/0321857 | A1 | 11/2015 | Sachetti et al. | |
| 2018/0072551 | A1 | 3/2018 | Burkhard et al. | |
| 2021/0339901 | A1 * | 11/2021 | Rosignoli | B65B 35/24 |

* cited by examiner

METHOD AND APPARATUS FOR AUTOMATICALLY BOXING PRODUCTS ON STICK

This application claims priority to Italian Patent Application 102020000009424 filed Apr. 29, 2020, the entirety of which is incorporated by reference herein.

BACKGROUND OF THE INVENTION

This invention relates to an apparatus for automatically boxing products on stick, in particular ice creams on stick.

This invention also relates to a method for automatically boxing products on stick, in particular ice creams on stick, performed by the above-mentioned automatic boxing apparatus.

SUMMARY OF THE INVENTION

The expression "products on stick" generally means food products comprising a stick having a support function for the edible product and functions for gripping by the user at the time of consumption.

In the technical sector according to the invention, products on stick are packed directly inside the box, without providing any wrapper for each individual product, which therefore takes the conventional name of naked product.

The apparatuses for automatically boxing products on prior art sticks use transport lines on which the products on stick are moved, which are then picked up by picking units and are housed in suitable boxes for any transport and final sale.

Generally, the automatic boxing apparatuses comprise a series of units movable along the transport lines, each designed to house and retain at least one product on stick.

The products on stick are presented at the entrance to the automatic boxing apparatus, where a loading device positions them on the respective units at a loading area.

The units, moving along the transport line, transport the products on stick from the loading zone to an unloading zone, where the products on stick are picked up by the respective units and placed inside boxes using the above-mentioned pick-up units.

In industrial processes, the number of products on stick to be boxed inside each box is predetermined and may not be subject to variations, so as not to adversely affect the quality of the end product and the satisfaction of the user.

In fact, an excessive number of products on stick could result in excessive compression of the products in the box, with possible deterioration of at least part of them.

On the other hand, an insufficient number of products would result in dissatisfaction of the end consumer, who would pay for fewer products than those stated on the outside of the box.

In that sense, in the automatic boxing apparatuses in use, control measures are implemented designed to minimize the boxing errors, so as to guarantee an optimum and constant quality of the finished and boxed product.

The most banal of these control systems is that comprising a human control downstream of the picking and boxing station. According to that system, an operator visually assesses the contents of the box before it is sealed and checks that the number of products inside the box corresponds to the predetermined number.

However, this method has obvious drawbacks typical of human activities with respect to automated activities, mainly in terms of effectiveness and efficiency of the control process.

Solutions of automatic boxing apparatuses have therefore been proposed which are able to measure the actual positions of the products on stick using control systems integrated in the apparatus.

As a function of the positions detected by the control system, the apparatus adapts the operations for picking up from the units so that the pick-up units pick up and always place the same number of product on stick.

These solutions require picking units which are able to adapt to the real positions of the products on stick on the units so as not to perform the picking operations at the units which do not transport products to be packed.

The implementation of said picking units results in a considerable increase in the complexity of the automatic boxing apparatus, and in particular of the pick-up unit, which must be able to adapt to the actual positions of the products on stick, with consequent increases in the production, management and maintenance costs.

The aim of the invention is to provide an apparatus for automatically boxing products on stick with a particularly simple, flexible structure and with particularly reduced production, management and maintenance costs.

Another aim of the invention is to provide a method for automatically boxing products on stick with a high efficiency and effectiveness and implementation which is particularly flexible and simplified.

BRIEF DESCRIPTION OF THE DRAWINGS

The advantages and features of an apparatus and a method for automatically boxing products on sticks according to the invention are more apparent in the detailed description below of an embodiment, with reference to the accompanying drawings, in which.

DESCRIPTION OF THE PREFERRED EMBODIMENTS

With reference to the accompanying drawings, the numeral 1 denotes an apparatus for automatically boxing products on stick P.

In the following description, the term "products on stick" denotes products, preferably in the food sector, comprising a stick P1 having product supporting functions and functions for gripping by the user at the time of consumption.

Examples of commonly used products belonging to this category are ice lollies or ice creams having a stick, preferably made of wooden material, to facilitate gripping by the end consumer.

The automatic boxing apparatus according to the invention is designed, preferably, for automatically boxing naked type products on sticks, that is to say, products on stick directly inside the box without providing any individual wrapper for each individual product.

In the accompanying drawings, the products on stick P are shown as ice creams on stick comprising an elongate stick P1, partly inserted in the product on stick and partly emerging from said product on stick.

Figure 1:
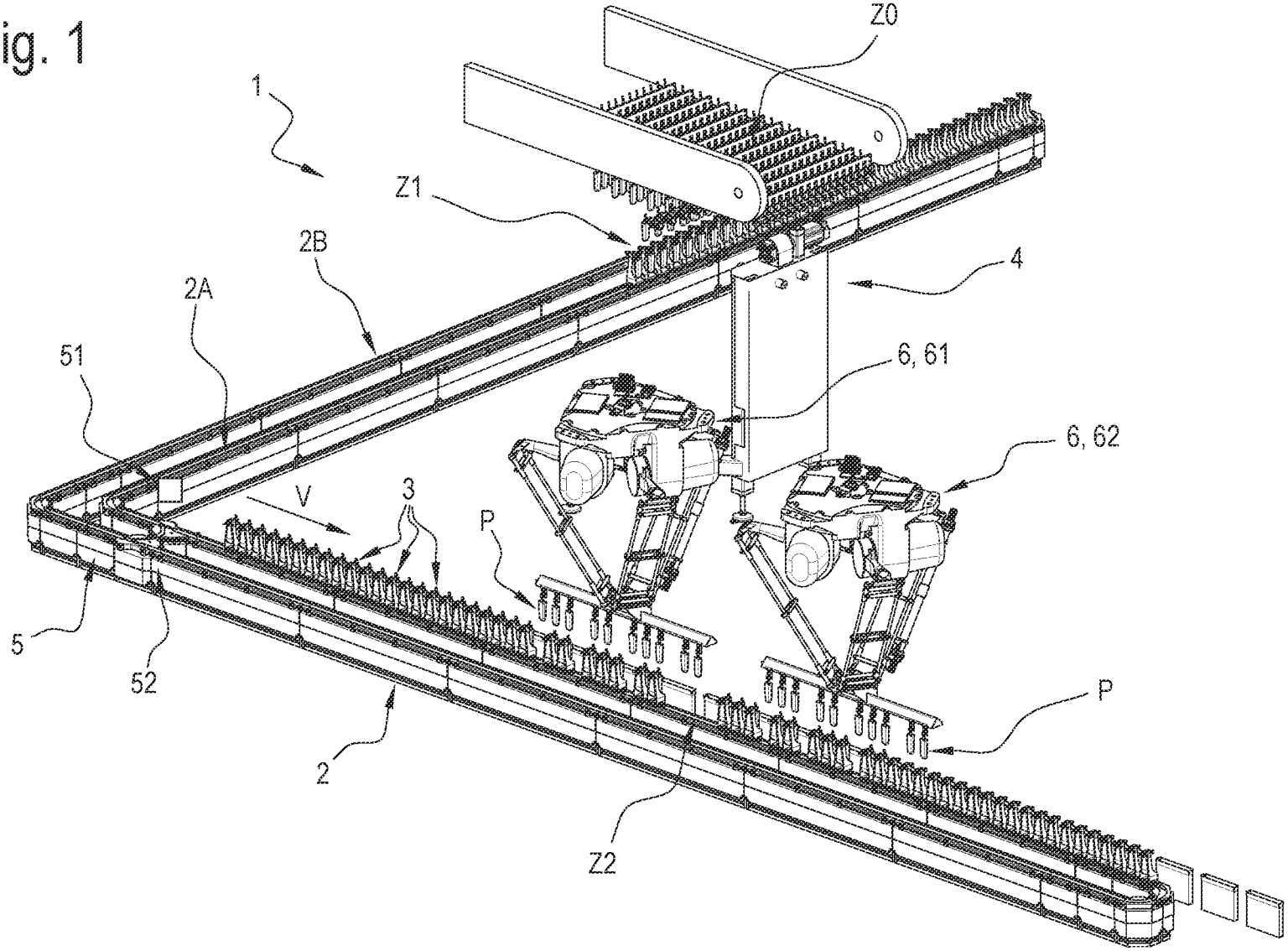
FIG. 1 illustrates a perspective view of an embodiment of the automatic boxing apparatus according to the invention.
Figure 3:
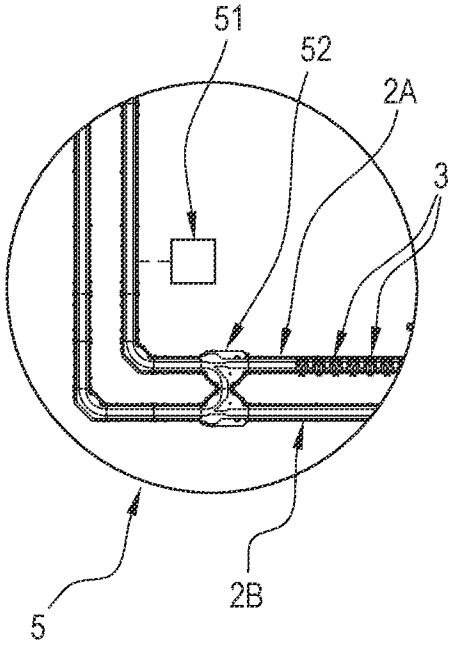
FIG. 3 illustrates a top view of the detail of the automatic boxing apparatus shown in FIG. 2.
Figure 2:
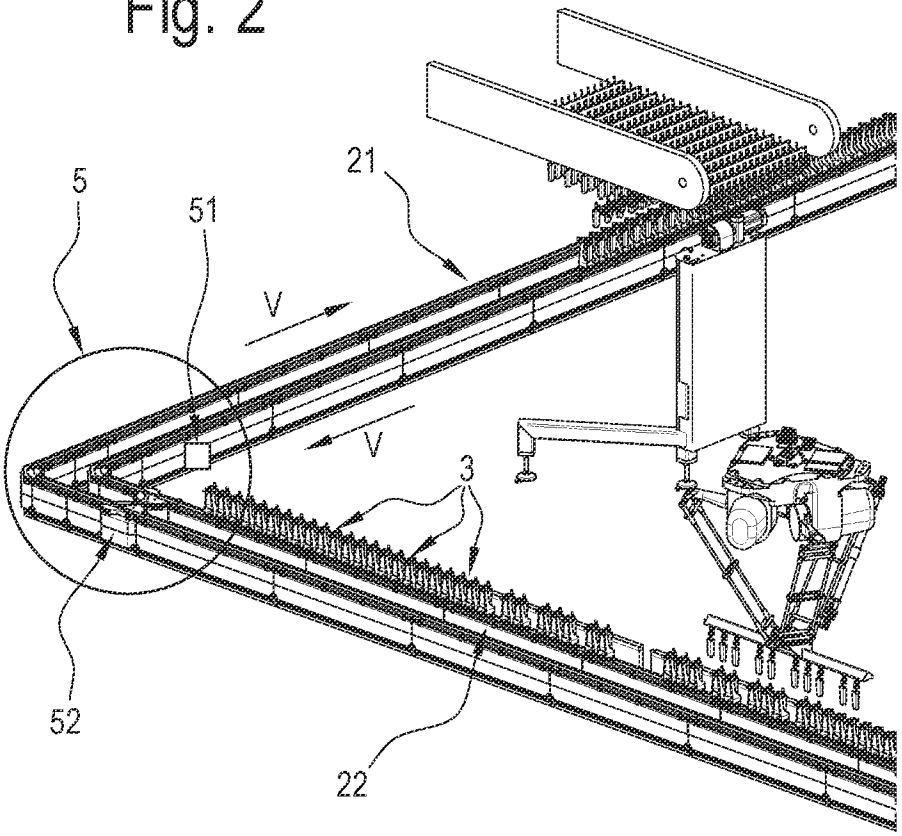
FIG. 2 illustrates a perspective view, highlighted by means of a circle, of a detail of the automatic boxing apparatus of FIG. 1.

As illustrated in particular in FIGS. 1 to 3, the apparatus 1 comprises a transport line 2.

According to an aspect, said transport line 2 is a closed transport line, that is to say, a transport line in which the starting point and the end point of the line coincide.

In an embodiment, the transport line 2 comprises a track, along which movable elements can slide which are described below.

As illustrated, the transport line 2 comprises a forward guide 2A and a return guide 2B which are in communication with each other.

Preferably, the starting point of the forward guide 2A coincides with the end point of the return guide 2B and, similarly, the starting point of the return guide 2B coincides with the end point of the forward guide 2A.

In other words, the forward guide 2A and the return guide 2B are in communication with the respective ends.

Preferably, the forward guide 2A and the return guide 2B are parallel to each other along at least part of their path.

Preferably, the transport line 2 is made of conductive material, generally made of metal material.

According to an embodiment, the transport line 2 comprises conductive elements and is configured to be passed through locally by current along said conductive elements.

The local currents in circulation along said conductive elements are, preferably, supplied by a current generator, not illustrated, and modulated by a control unit, also not illustrated.

According to another embodiment, the transport line 2 is magnetically polarized in a local manner, that is to say, it has a magnetic polarization which is variable and permanent along its extension.

According to an embodiment, illustrated in particular in FIG. 2, the transport line 2 comprises a first portion 21 and a second portion 22, positioned at an angle to each other.

In the embodiment illustrated, the first portion 21 and the second portion 22 are set at an angle to each other to form an angle of 90°.

In other embodiments, the angle formed between the first portion 21 and the second portion 22 may adopt different values, depending on the space dedicated to installation of the apparatus 1.

As illustrated in the accompanying drawings, the apparatus 1 comprises a plurality of units 3 associated with the transport line 2.

More specifically, the units of the plurality of units 3 are movable along the forward guide 2A and the return guide 2B in a feed direction V.

More precisely, in the straight stretches of the transport line 2, the units 3 are movable along the forward guide 2A and the return guide 2B according to feed directions V from the opposite direction.

According to an aspect of the invention, each unit of the plurality of units 3 is movable independently of the other units 3 along said transport line 2.

In other words, the movement of each unit is independent of the position or movement of the other units of the plurality of units 3.

According to an embodiment, each unit 3 is magnetically polarized in a permanent fashion.

According to another embodiment, each unit 3 comprises conductive elements configured to be passed through locally by current.

The local currents in circulation along said conductive elements are, preferably, supplied by a current generator, preferably portable and not illustrated, and modulated by a control unit, also not illustrated.

Preferably, when each unit of the plurality of units 3 is magnetically polarized, the transport line 2 comprises conductive elements and is configured to be passed through locally by current along said conductive elements.

Similarly, when the transport line 2 is magnetically polarized in a local fashion, each unit of the plurality of units 3 comprises conductive elements configured for being passed through by currents.

According to the two configurations just described, the movement of the plurality of units 3 along the transport line 2 is controlled by a linear motor.

Advantageously, the use of a linear motor comprises the application of a local electromagnetic induction principle to trigger the movement of each individual unit 3 independently of the other units 3, preferably as a function of its position on the transport line 2.

Again advantageously, the use of a linear motor allows particularly precise movement of the units 3.

Figure 11:
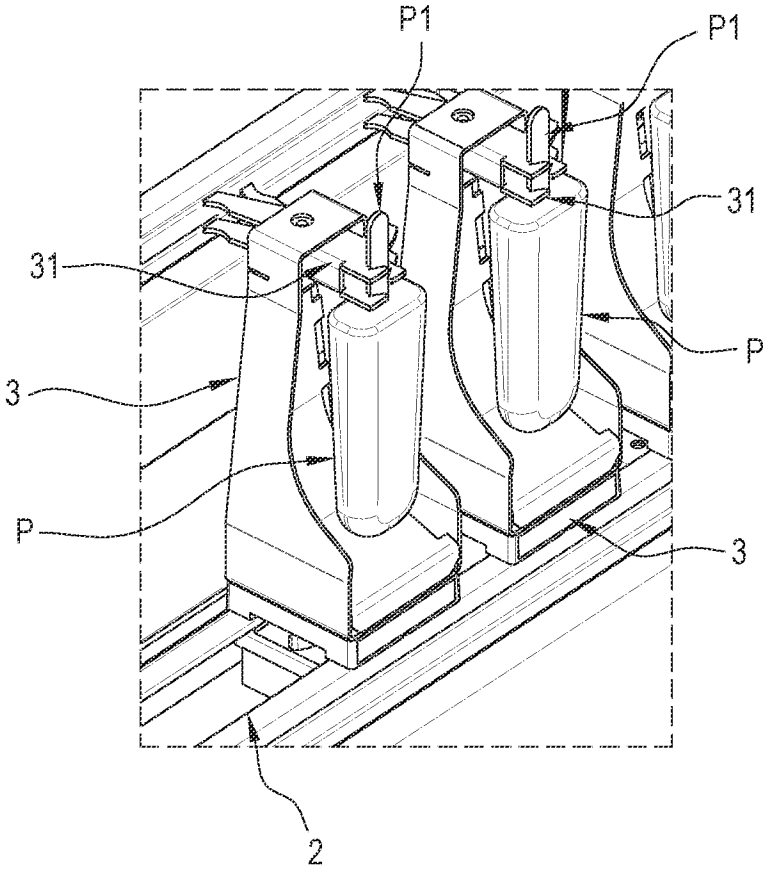
FIG. 11 illustrates an alternative perspective view of the plurality of elements of the automatic boxing apparatus illustrated in FIG. 10.
Figure 10:
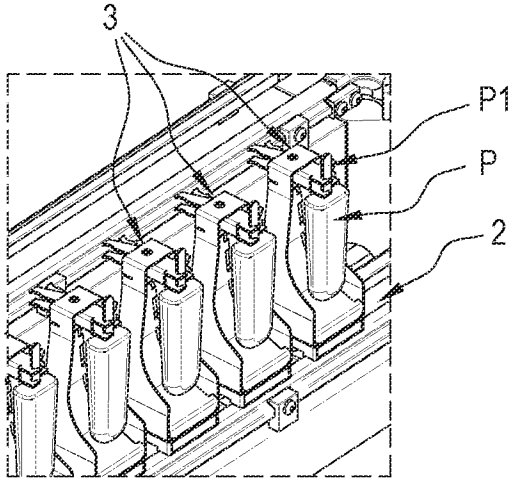
FIG. 10 illustrates a perspective view of a plurality of elements of the automatic boxing apparatus of FIG. 1.
Figure 12:
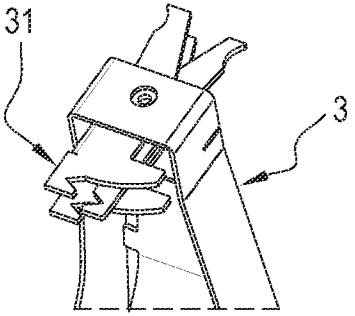
FIG. 12 illustrates a perspective view from above of an element of the plurality of elements of the automatic boxing apparatus illustrated in FIGS. 10 and 11.

As illustrated in particular in FIGS. 10 to 12, each unit of the plurality of units 3 comprises a retaining system 31 configured to hold the product on stick P.

Preferably, the retaining system 31 is composed of two elements movable between a closed position for retaining the product on stick P, preferably at the stick P1, and an open position in which it is possible to insert or pick up the product on stick P.

In FIGS. 10 to 12, the retaining system 31 is shown in the closed position, wherein the two movable elements are facing each other to form a seat for the stick P1, inside of which the stick is retained and the product on stick P is attached to the respective unit 3.

In the open position, not illustrated, the two movable elements of the retaining system 31 are spaced in such a way as to create an opening in the seat of said stick P1 for inserting or picking up the product on stick P.

The change of configuration between the open and closed positions of the retaining system 31 is controlled by a mechanical or electromechanical system, depending on the embodiment.

Figure 5:
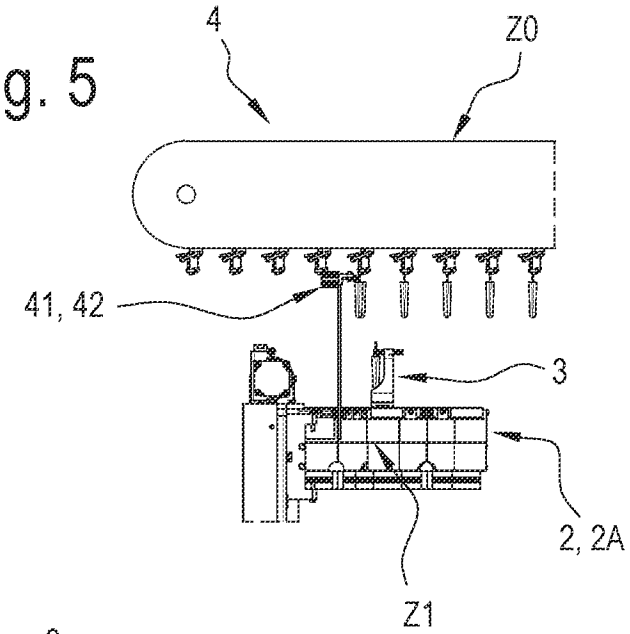
FIG. 5 illustrates a side view of the element of the automatic boxing apparatus of FIG. 4.
Figure 4:
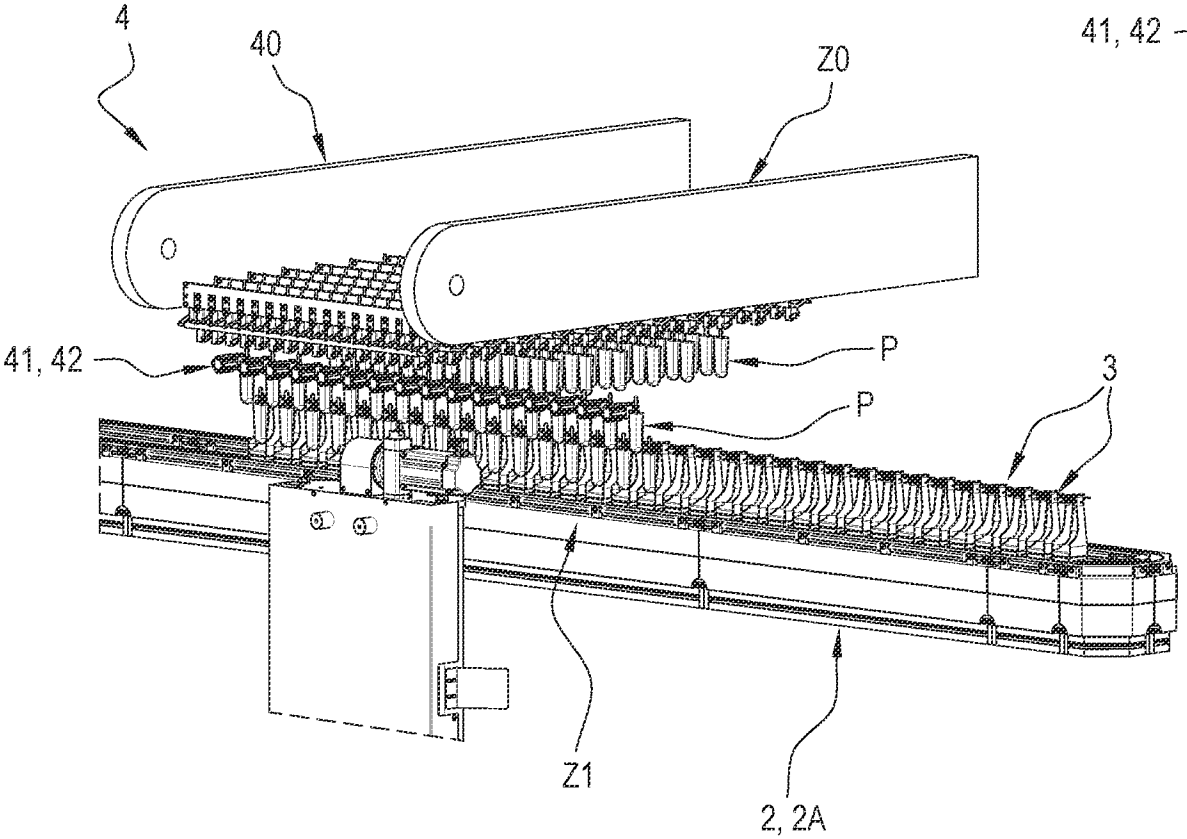
FIG. 4 illustrates a perspective view of an element of the automatic boxing apparatus of FIG. 1.

As illustrated in FIG. 1 and in more detail in FIGS. 4 and 5, the apparatus 1 comprises a loading unit 4, operatively connected to the transport line 2.

Said loading unit 4 is configured to load, at a loading zone Z1 of the forward guide 2A, a predetermined number of products on stick P on an equivalent number of units 3.

More specifically, the loading unit 4 is configured for picking up a predetermined number of products on stick P from an accumulation zone Z0 and for placing said predetermined number of products on stick P on an equivalent number of units 3, positioned at the loading zone Z1 on the forward guide 2A.

In the embodiment illustrated in the accompanying drawings, the loading unit 4 comprises a transport element 40 for transporting the products on stick P from a production zone, not illustrated, to the accumulation zone Z0.

Preferably, in order to perform the picking up and loading of the products on stick P, the loading unit 4 comprises a loading element 41, illustrated in FIGS. 4 and 5 in an embodiment.

The loading element 41 is configured for transporting a predetermined number of products on stick P from the accumulation zone Z0 to the loading zone Z1 and loading said predetermined number of products on stick P on an equivalent number of units 3 present on the forward guide 2A in said loading zone Z1.

In the embodiment of FIG. 4, the loading element 41 is configured for picking up sixteen products on stick P from the accumulation zone Z0 and for loading said sixteen products on stick P on as many units 3, stationary in the loading zone Z1.

Preferably, the loading element 41 comprises a plurality of picking up elements 42, each configured for picking up a product on stick P from the accumulation zone Z0 and transporting said product on stick P to the loading zone Z1, where the product on stick P is loaded on a unit 3 and retained by the respective retaining system 31.

In order to support the product on stick during transport from the accumulation zone Z0 to the loading zone Z1, the picking up element 42 comprises a picking up system 43.

Preferably, the picking up system 43 is composed of two elements movable between a closed position for retaining the product on stick P, preferably at the stick P1, and an open position in which it is possible to insert or pick up the product on stick P.

Figure 14:
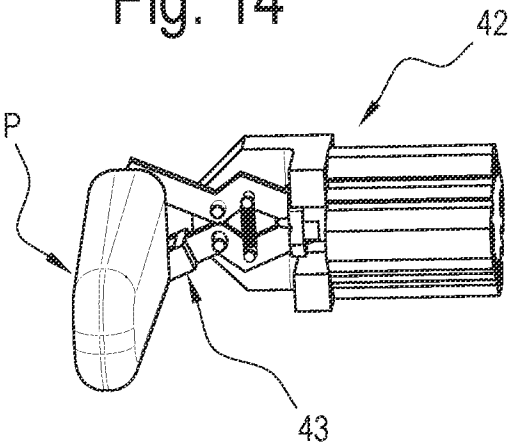
FIG. 14 illustrates a perspective view from below of the detail of the element of the automatic boxing apparatus of FIG. 13.
Figure 15:
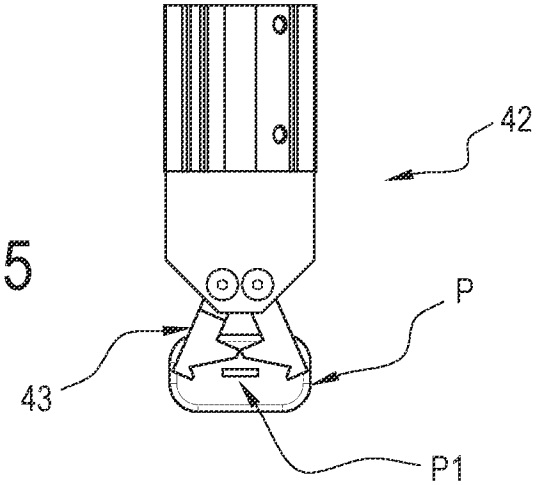
FIG. 15 illustrates a top view of the detail of the element of the automatic boxing apparatus of FIGS. 13 and 14.
Figure 13:
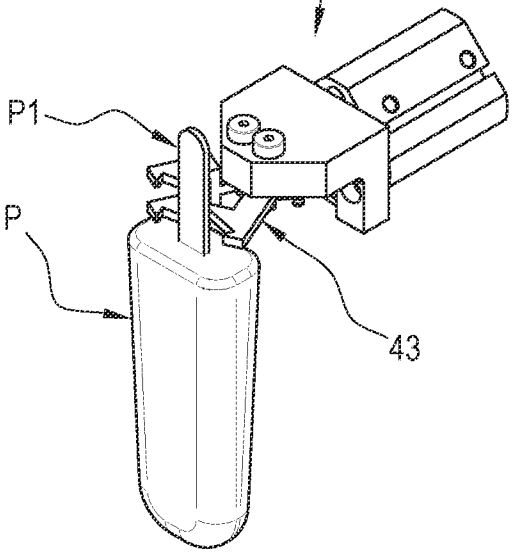
FIG. 13 illustrates a perspective view from above of a detail of an element of the automatic boxing apparatus of FIG. 1.

In the open position, illustrated in FIGS. 13 to 15, the two movable elements of the picking up system 43 are spaced in such a way as to create an opening in a seat of said stick P1 for inserting or picking up the product on stick P.

In the closed position, not illustrated, the picking up system 43 has the two movable elements facing each other to form said seat for the stick P1, inside of which the stick is retained and the product on stick P is attached to the respective picking up element 42.

The change of configuration between the open and closed positions of the picking up system 43 is controlled by a mechanical system, as in the embodiment illustrated in FIGS. 13 to 15 where a pusher and an opposing, or electromechanical, spring are used in alternative embodiments.

According to an aspect of the invention, the apparatus 1 comprises a control and return unit 5, operatively connected to the transport line 2 and illustrated in more detail in FIGS. 2 and 3.

Advantageously, the control and return unit 5 is positioned downstream of the loading unit 4 relative to the feed direction V of the units 3 along the forward guide 2A.

The control and return unit 5 is configured to control the presence of products on stick P in the units 3 in transit along the forward guide 2A, at the control and return unit 5.

Preferably, the control and return unit 5 comprises a sensor 51, configured to detect the presence or absence of said product on a stick P on each of the units 3 in transit on the forward guide 2A.

Still more preferably, the sensor 51 is an optical presence sensor.

More specifically, the control and return unit 5 is configured to selectively interrupt the movement of the units 3 along the forward guide 2A in the feed direction V and to move the units 3 whose movement has been interrupted from the forward guide 2A to the return guide 2B, without them completing their path on the forward guide.

More specifically, in this description, the selective interruption of the movement of the units 3 means the interruption of the forward movement along the forward guide 2A of the units 3 which do not retain a product on stick P and the consequent movement of said units on the return guide 2B.

The units 3 which are detected by the control and return unit 5 as transporting a product on stick P are, on the other hand, left to continue along the forward guide 2A in the feed direction.

Advantageously, this prevents units 3 which do not transport a product on stick P from continuing their movement along the forward guide 2A and which, therefore, reach positions, along the forward guide 2A, where they would undergo unnecessary actions in view of the absence of product on stick P.

Preferably, as illustrated in particular in FIG. 3, the control and return unit 5 comprises an exchange guide 52.

Said exchange guide 52 is movable between a first active connecting position and a second inactive isolation position.

In the first active connecting position, the exchange guide 52 connects the forward guide 2A with the return guide 2B to interrupt the movement of the units 3 along the forward guide 2A in the feed direction V and to move said units 3 from the forward guide 2A to the return guide 2B.

Advantageously, the exchange guide 52 is in the first active connecting position when a unit 3 is in transit which does not transport a product on stick P, as detected preferably by the sensor 51.

In the second inactive isolation position, the exchange guide 52 locally disconnects the forward guide 2A with the return guide 2B so as to allow the transit of the units 3 along the forward guide 2A in the feed direction V.

Advantageously, the exchange guide 52 is in the second active isolation position when a unit 3 carrying a product on stick P is in transit, as detected preferably by the sensor 51.

In an embodiment, the control and return unit 5 comprises a switching unit, not illustrated, operatively connected to the exchange guide 52 and in communication with the sensor 51.

The switching unit is configured to perform the status switching of the exchange guide 52 between the first active connecting position and the second inactive isolation position.

The switching unit is preferably in communication with the sensor 51.

Still more preferably, the switching unit operates as a function of a signal, sent by the sensor 51, representing the presence or absence of a product on stick P on the unit in transit on the exchange guide 52.

In this way, the movement along the forward guide 2A in the feed direction V is allowed only of the units 3 which the sensor 51 has detected as transporting a product on stick P.

Advantageously, the units 3 detected by the sensor 51 as not transporting a product on stick P are, on the other hand, transported on the return guide 2B, without them complete their path on the forward guide 2A and therefore being subjected to unnecessary activities, in view of the absence of product on stick.

Again advantageously, downstream of the control and return unit 5 relative to the feed direction V, only units 3 which transport a product on stick P are located on the forward guide 2A and the subsequent operations performed by the components of the apparatus 1 are performed in optimum conditions.

According to another aspect of the invention, the apparatus 1 comprises a unloading unit 6 operatively connected to the transport line 2.

Advantageously, the unloading unit 6 is positioned downstream of the control and return unit 5 relative to the feed direction V of the units 3 along the forward guide 2A.

As illustrated in FIG. 1, the unloading unit 6 comprises at least one picking unit 61, 62.

Said at least one picking unit 61, 62 is configured for picking up, at an unloading zone Z2 of the forward guide 2A, a predetermined number of products on stick P from the units 3 and boxing said predetermined number of products on stick P inside a plurality of boxes S.

In the embodiment illustrated in the accompanying drawings, the unloading unit 6 comprises two picking units 61, 62, positioned in two adjacent positions in the unloading zone Z2 of the forward guide 2A.

Advantageously, the use of more than one picking unit allows each picking unit to fill each box S only partly so that the complete filling of the box occurs in several steps.

In this way, it is advantageously possible to box the products on stick P inside the respective boxes S in such a way that the distance of the adjacent products on sticks inside the box S is less than the minimum distance between adjacent units on the transport line 2, and thus of the products on stick transported by said units.

Still more advantageously, the boxing of the products on stick P inside the boxes S is optimum in terms of use of the space inside the boxes.

In order to pick up the products on stick P from the units and transport said products on stick inside the boxes S, the at least one picking unit 61, 62 comprises a plurality of picking elements 63.

Figure 6:
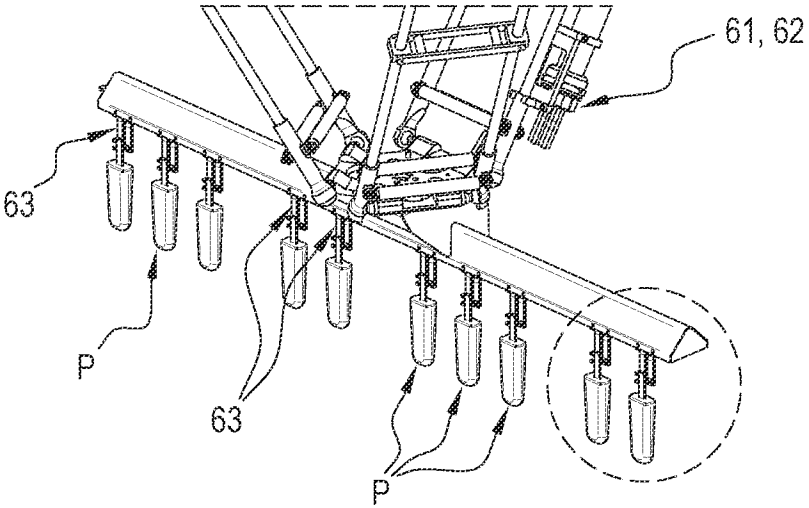
FIG. 6 illustrates a perspective view of an element of the automatic boxing apparatus of FIG. 1.
Figure 8:
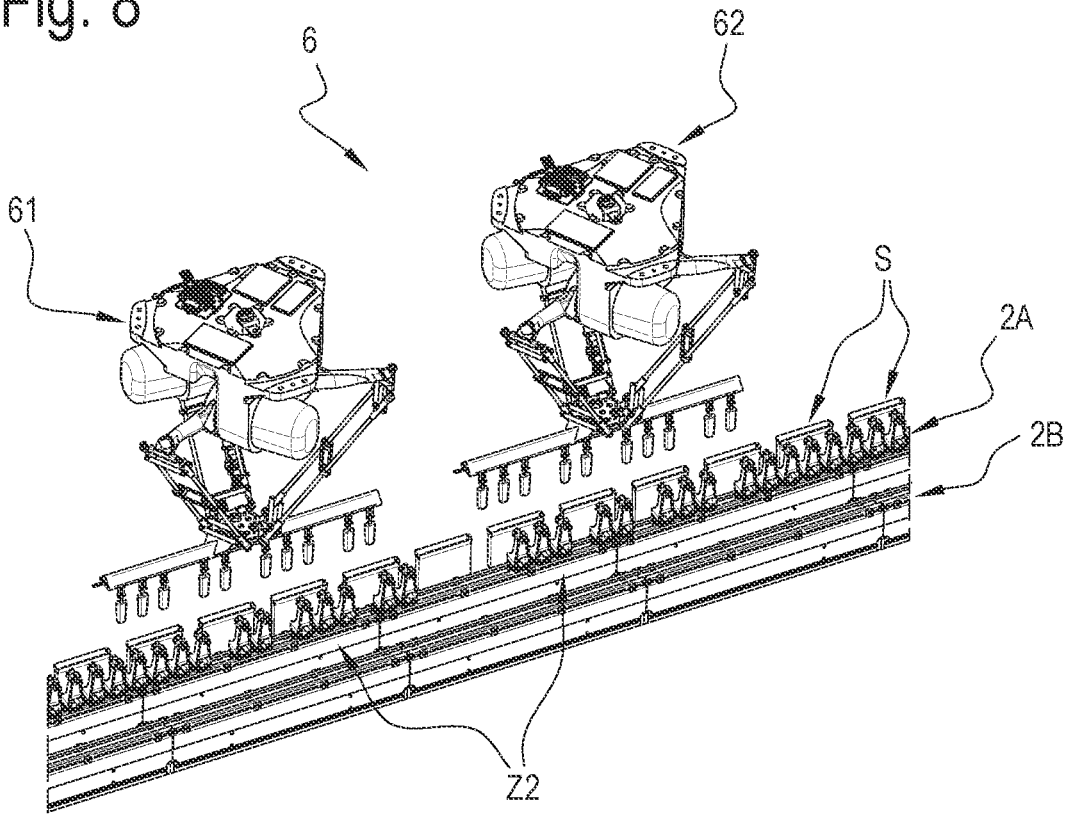
FIG. 8 illustrates a perspective view of an element of the automatic boxing apparatus of FIG. 1.

In the embodiment illustrated in detail in FIG. 6, each picking unit 61, 62 comprises ten picking elements 63.

In order to support the product on stick P during transport from the unloading zone Z2 to the plurality of boxes S, each picking element 63 comprises a picking system 64.

Preferably, the picking up system 64 is composed of two elements movable between a closed position for retaining the product on stick P, preferably at the stick P1, and an open position in which it is possible to insert or pick up the product on stick P.

In the open position, not illustrated, the two movable elements of the picking system 64 are spaced in such a way as to create an opening in a seat of said stick P1 for inserting or picking up the product on stick P.

Figure 7:
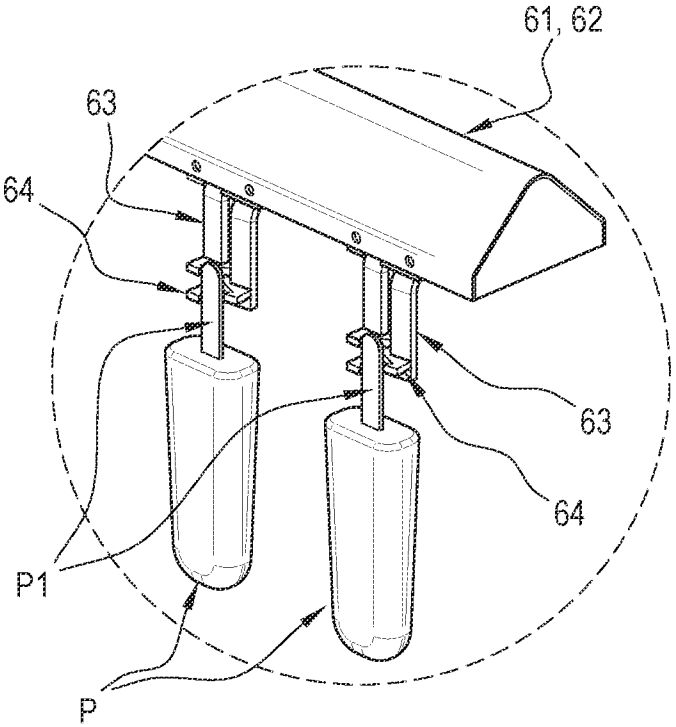
FIG. 7 illustrates a perspective view of a detail of the element of the automatic boxing apparatus of FIG. 6.

In the closed position, illustrated in FIG. 7, the picking up system 64 has the two movable elements facing each other to form said seat for the stick P1, inside of which the stick is retained and the product on stick P is attached to the respective picking element 63.

The change of configuration between the open and closed positions of the picking system 64 is controlled by a mechanical or electromechanical system, depending on the embodiment.

Figure 16:
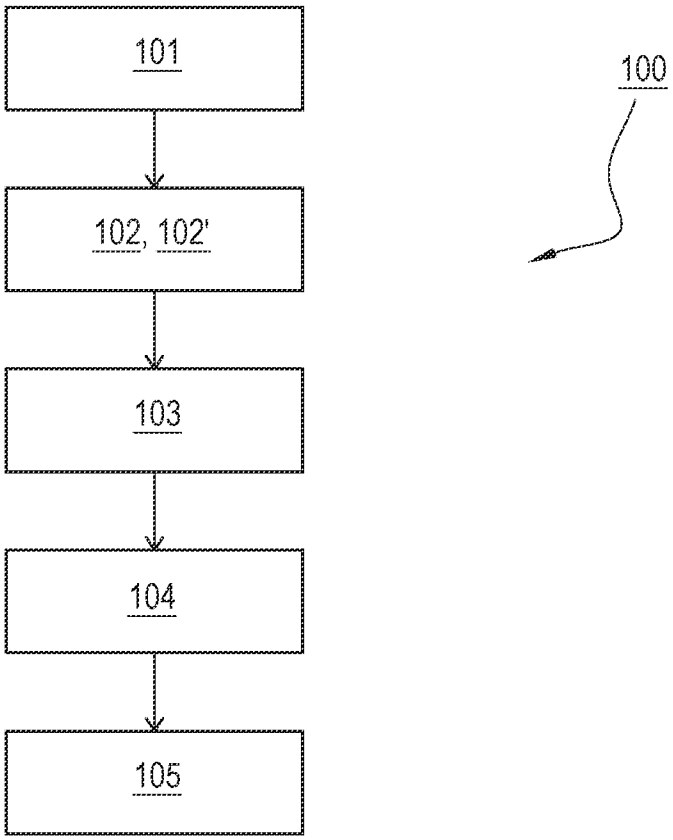
FIG. 16 illustrates a block diagram of the steps of the automatic boxing method according to the invention.

This invention also illustrates a method 100 for automatically boxing products on stick P, illustrated in its steps in FIG. 16.

According to the invention, the automatic boxing method 100 comprises a preparing step 101 in which the transport line 2 is prepared, comprising in turn the forward guide 2A and the return guide 2B communicating with each other, the plurality of units 3, the control and return unit 5 and the unloading unit 6.

Preferably, the preparing step 100 comprises preparing the loading unit 4.

Still more preferably, the preparing step 100 comprises preparing the sensor 51.

The composition and arrangement of the above-mentioned components are the same as those described above in this description.

As illustrated in FIG. 16, the method 100 preferably comprises a placing step 102, during which the products on stick P are placed on the plurality of units 3.

Following this positioning step 102, the products on stick P are held by the respective units 3 and are moved along the transport line 2.

Preferably, the placing step 102 comprises a loading step 102'.

During the loading step 102', the loading unit 4 loads, at a loading zone Z1 of the forward guide 2A, a predetermined number of products on a stick P on an equivalent number of units 3.

Preferably, said predetermined number of products on stick P are picked up from an accumulation zone Z0, wherein the products on stick P remain stationary, after the respective production, waiting to be loaded on an equivalent number of units 3.

In the embodiment shown in FIGS. 4 and 5, during the loading step 102', sixteen products on stick P are picked up from the accumulation zone Z0 and are loaded on respective sixteen units 3 present in the loading zone Z1.

Again as illustrated in FIG. 16, the method 100 comprises a transporting step 103.

During the conveying step 103, the plurality of units 3 is moved along said transport line 2, preferably firstly on the forward guide 2A and then on the return guide 2B according to the feed direction V.

According to an aspect of this invention, during the transport step 3, each unit of the plurality of units 3 is moved independently of the other units.

In other words, the movement of each unit is independent of the position or movement of the other units of the plurality of units 3.

Preferably, the transporting step 103 comprises the movement of each unit of said plurality of units 3 by means of a linear motor.

According to this configuration, a local electromagnetic induction principle is used for triggering the movement of each individual unit 3, as a function of its position on the transport line 2.

According to an embodiment, the transport line 2 is locally equipped with conductive elements, configured to be passed through by local currents, and the units 3 are made of magnetically polarized material.

According to another embodiment, the transport line 2 is locally equipped with magnetically polarized elements and the units 3 comprise conductive elements, configured to be passed through by local currents generated by a source of electricity.

Advantageously, by suitably modulating the flow of the current inside the conductive elements locally, it is possible to locally control the movement of each unit independently from the other units.

Again advantageously, the use of a linear motor allows particularly precise movement of the units 3.

According to another aspect of the invention, the method 100 comprises a control and return step 104.

During the control and return step 104, the control and return unit 5 controls, for each unit of the plurality of units 3, the presence or absence of the product on stick P.

Based on this information regarding the presence or absence of the product on stick P, the control and return unit 5 selectively interrupts the movement of the units 3 along the forward guide 2A and moves said units 3 from the forward guide 2A to the return guide 2B.

Preferably, the control and return unit 5 interrupts the movement along the forward guide 2A of the units 3 which do not have a product on stick P and moves said units 3 without product on stick from the forward guide 2A to the return guide 2B, without these completing their path along the forward guide 2A.

Preferably, the detection of the presence or absence of said product on the stick P on each of the units 3 in transit through the forward guide 2A is performed by means of said sensor 51.

Even more preferably, the control and return step 104 comprises the forward movement on the forward guide 2A of the units 3 which said sensor 3 has detected have a product on stick P and the transport on the return guide 2B of the units 3 which said sensor 3 has detected do not have a product on stick P.

In this way, the movement along the forward guide 2A in the feed direction V is advantageously allowed only of the units 3 which the sensor 51 has detected as transporting a product on stick P.

Again advantageously, the units 3 which do not transport a product on stick P continue to move along the forward guide 2A and therefore reach positions along the forward guide 2A where they would undergo unnecessary actions, in view of the absence of product on stick P.

As illustrated in FIG. 16, the method 100 comprises an unloading step 105 wherein said unloading unit 6 picks up, at an unloading zone Z2 of the forward guide 2A, a predetermined number of products on stick P from said plurality of units 3 for placing them inside a plurality of boxes S.

Preferably, in the unloading step 105 the filling of each box S occurs in several steps, that is to say, each box is firstly filled partially at a first step and the total filling of the box occurs in at least one subsequent step.

Figure 9:
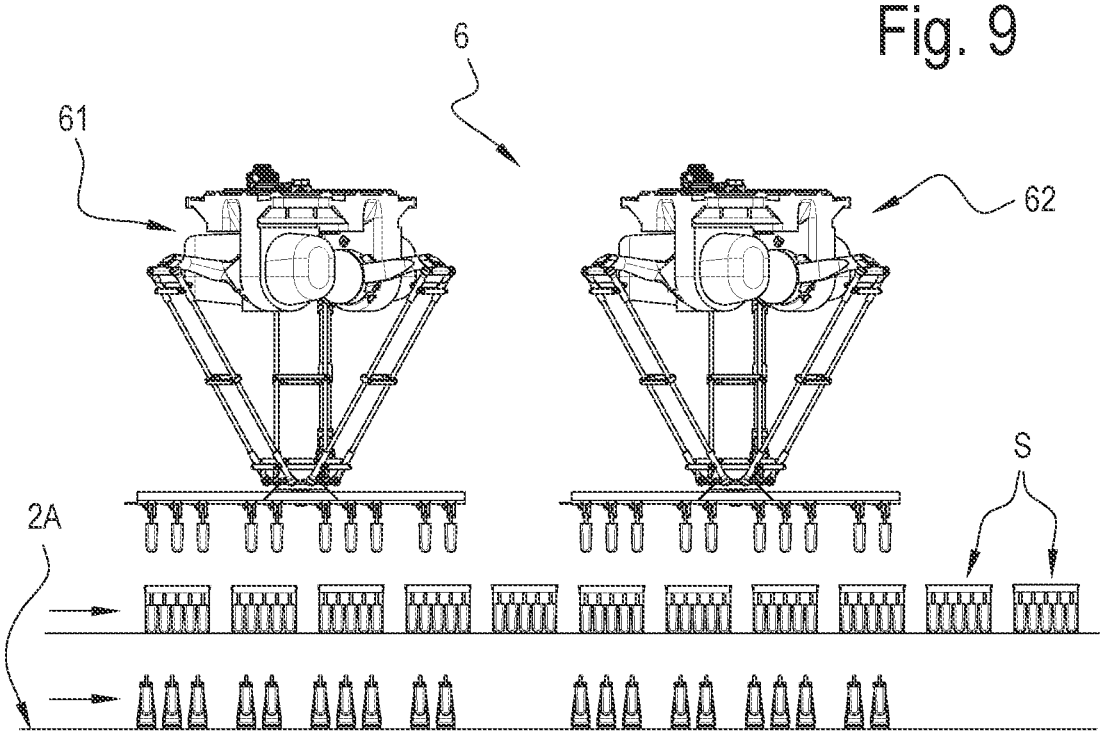
FIG. 9 schematically illustrates the operation of the element of the automatic boxing apparatus of FIG. 8.

In the embodiment of FIG. 9, wherein the unloading unit 6 comprises two picking units, the boxes S are filled in two steps and comprises the boxing of five products on stick P per box.

In that embodiment, at the first picking unit 61, four boxes S are firstly filled with two or three products on stick P, depending on their position.

Subsequently, at the second picking unit 62, each of the four boxes S is filled with three or two products on stick P, depending on whether the box has been filled with two or three products on stick P by the first picking unit, so as to fill each box S with five products on stick P.

In this way, it is advantageously possible to box the products on stick P inside the respective boxes S in such a way that the distance between adjacent products on stick inside the box S is less than the minimum distance between the units 3 on the transport line 2, thus of the products on stick transported by said units.

Preferably, the unloading step 105 comprises placing said plurality of products on stick P inside said plurality of boxes S without each product on stick P having an individual wrapper, that is to say, the products on stick are packed in naked mode.

The automatic boxing apparatus according to the invention makes it possible to provide an apparatus for automatically boxing products on stick with a particularly simple, flexible structure and with particularly reduced production, management and maintenance costs.

The automatic boxing method, which is also the object of this invention, makes it possible to provide method for automatically boxing products on stick with a high efficiency and effectiveness and implementation which is particularly flexible and simplified.

What is claimed is:

1. An apparatus for automatically boxing products on a stick comprising:

a closed transport line comprising, in turn, a forward guide and a return guide which are in communication with each other;

a plurality of units, associated with said transport line, movable along the forward guide and the return guide in a feed direction, each carrier comprising a retaining system for retaining a product on a stick;

an unloading unit, operatively connected to the transport line, comprising at least one collection unit configured for picking up, at an unloading zone of the forward guide, a predetermined number of the product on the stick from the units and boxing said predetermined number of the product on the stick;

wherein each unit of said plurality of units is movable independently from the other units along the transport line;

a control and return unit, positioned upstream relative to the unloading unit relative to the feed direction along the forward guide, operatively connected to the transport line, configured for controlling a presence of the product on the stick in the units moving along the forward guide, to selectively interrupt the movement of the units in the feed direction at the forward guide and to move said units from the forward guide to the return guide.

2. The apparatus according to claim 1, and further comprising a loading unit, operatively connected to the transport line, positioned upstream relative to the control and return unit relative to the feed direction along the forward guide, configured for loading, at a loading zone of the forward guide, a predetermined number of the product on the stick on an equivalent number of units.

3. The apparatus according to claim 2, wherein the control and return unit comprises an exchange guide, movable between a first active connecting position connecting the forward guide with the return guide for interrupting at the forward guide the movement of the units in the feed direction and for moving said units from the forward guide to the return guide, and a second inactive isolation position to allow the transit of the units in the forward feed direction along the forward guide.

4. The apparatus according to claim 1, wherein the control and return unit comprises a sensor, configured to detect a presence or absence of said product on the stick on each of the units in transit on the forward guide.

5. The apparatus according to claim 3, wherein the control and return unit is configured to allow the forward movement in the feed direction on the forward guide of the units which said sensor has detected has the product on the stick and to return, by said exchange guide, on the return guide the units which said sensor has detected do not have the product on the stick.

6. The apparatus according to claim 1, wherein the transport line comprises a first portion and a second portion, positioned at an angle to each other.

7. The apparatus according to claim 1, wherein the at least one collection unit comprises a plurality of collection elements.

8. The apparatus according to claim 1, wherein the at least one collection unit comprises two collection units.

9. The apparatus according to claim 1, wherein the loading unit comprises a loading element configured for transporting a predetermined number of the product on the stick from an accumulation zone to the loading zone and loading said predetermined number of the product on the stick on an equivalent number of units present in said loading zone.

10. A method for automatically boxing products on a stick comprising:

a preparing step wherein a closed transport line is prepared comprising in turn a forward guide and a return guide communicating with each other, a plurality of units, a control and return unit and an unloading unit;

a step of placing products on a stick on the plurality of units;

a step of transporting the plurality of units, wherein the plurality of units is moved along said transport line;

an unloading step wherein said unloading unit picks up, at an unloading zone of the forward guide, a predetermined number of the product on the stick from said plurality of units for placing the predetermined number of the product on the stick inside a plurality of boxes;

wherein, during the transporting step each unit of the plurality of units is moved independently from the other units; a control and return step wherein said control and return unit controls, for each unit of the plurality of units, a presence or absence of the product on the stick, selectively interrupts the movement of the units along the forward guide and moves said units from the forward guide to the return guide.

11. The method according to claim 10, wherein the preparing step comprises preparing a loading unit and wherein the step of placing comprises a loading step during which the loading unit loads, at a loading zone of the forward guide, a predetermined number of the product on the stick on an equivalent number of the units.

12. The method according to claim 10, wherein the preparing step comprises preparing a sensor and wherein the control and return step comprises use of said sensor for detecting the presence or absence of the product on the stick on each of the units in transit on the forward guide.

13. The method according to claim 12, wherein the control and return step comprises the forward movement on the forward guide of certain ones of the plurality of units which said sensor has detected have the product on the stick and the transport on the return guide of other ones of the plurality of units which the sensor has detected do not have the product on the stick.

14. The method according to claim 10, wherein the transporting step comprises the movement of each unit of said plurality of units by a linear motor.

15. The method according to claim 10, wherein the unloading step comprises placing said plurality of the products on the stick inside said plurality of boxes without each of the product on the stick having an individual wrapper.

* * * * *